US007619572B2

(12) United States Patent
Su et al.

(10) Patent No.: US 7,619,572 B2
(45) Date of Patent: Nov. 17, 2009

(54) DUAL BAND ANTENNA

(75) Inventors: Jia-Hung Su, Taipei Hsien (TW); Ching-Chi Lin, Taipei Hsien (TW); Hung-Jen Chen, Taipei Hsien (TW); Kai Shih, Taipei Hsien (TW); Yu-Yuan Wu, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 239 days.

(21) Appl. No.: 11/752,766

(22) Filed: May 23, 2007

(65) Prior Publication Data

US 2008/0291091 A1 Nov. 27, 2008

(51) Int. Cl.
*H01Q 1/24* (2006.01)

(52) U.S. Cl. ..... 343/702

(58) Field of Classification Search ..... 343/700 MS, 343/702, 795, 722, 749
See application file for complete search history.

(56) References Cited

U.S. PATENT DOCUMENTS 6,417,816 B2 * 7/2002 Sadler et al. ..... 343/795
7,151,500 B2 * 12/2006 Su et al. ..... 343/795
7,495,620 B2 * 2/2009 Wang et al. ..... 343/702
2001/0011964 A1 * 8/2001 Sadler et al. ..... 343/824
2001/0045908 A1 * 11/2001 Keilen ..... 343/700 MS
2004/0116157 A1 * 6/2004 Vance et al. ..... 455/562.1
2004/0178957 A1 * 9/2004 Chang et al. ..... 343/700 MS
2005/0248489 A1 * 11/2005 Kim et al. ..... 343/702
2008/0266202 A1 * 10/2008 Lin et al. ..... 343/893
2008/0278389 A1 * 11/2008 Su et al. ..... 343/722

* cited by examiner

*Primary Examiner*—Huedung Mancuso
(74) *Attorney, Agent, or Firm*—WPAT, P.C.; Anthony King

(57) ABSTRACT

A dual band antenna has a ground portion, a first radiating conductor spaced from one side of the ground portion, a second radiating conductor connected between one end of the first radiating conductor and the ground portion, a third radiating conductor connected on the other end of the first radiating conductor, a fourth radiating conductor extended from the third radiating conductor, a parasitic element arranged to close to the second radiating conductor and connected to the ground portion and a feeding cable connected to the free end of the third radiating conductor. When the dual band antenna operates, the first, second and third radiating conductors obtain a first wireless location area network bandwidth covering 2.4 GHz to 2.5 GHz, and the third radiating conductor, the fourth radiating conductor and the parasitic element obtain a second wireless location area network bandwidth covering 4.9 GHz to 5.87 GHz.

8 Claims, 2 Drawing Sheets

DUAL BAND ANTENNA

BACKGROUND OF THE INVENTION

1. Field of the Invention

The invention relates to a dual band antenna, and particularly to a dual band antenna capable of operating at wireless location area network bandwidth.

2. The Related Art

Rapid innovation and development upon wireless communication technology have made mobile communication products as one of the mainstream products nowadays. These mobile communication products include mobile phones, PDAs, notebooks, etc. For sharing resources and transmitting data, the mobile communication products can couple with proper communication modules for linking by wiring or wirelessly with a Local Area Network (LAN) to transmit and receive e-mail and to receive instant information such as news, stocks quotations, and so on.

In recent years, Wireless Local Area Network (WLAN) mobile communication products under IEEE 802.11a/b/g standards, such as WLAN cards for computers are gaining popularity in wireless communication market. Wherein, IEEE 802.11b/g standard is suitable for working at 2.4 GHz frequency band covering 2.412 GHz to 2.462 GHz, while IEEE 802.11a standard is suitable for working at 5 GHz frequency band covering 4.9 GHz to 5.87 GHz. Many of the WLAN mobile communication products want to be use under both IEEE 802.11a and IEEE 802.11b/g standard benefit from antennas.

SUMMARY OF THE INVENTION

An object of the present invention is to provide a dual band antenna having a ground portion, a first radiating conductor, a second radiating conductor, a third radiating conductor, a fourth radiating conductor, a parasitic element. The first radiating conductor is spaced from one side of the ground portion. The second radiating conductor connects one end of the first radiating conductor and the ground portion. The third radiating conductor connects the other end of the first radiating conductor. The fourth radiating conductor extends from the third radiating conductor and towards the second radiating conductor. The parasitic element is arranged to close the second radiating conductor and connected to the ground portion. A feeding cable connects the free end of the third radiating conductor.

When the dual band antenna operates at wireless communication, the ground portion, the first radiating conductor, the second radiating conductor and the third radiating conductor form as a loop type antenna to obtain a first wireless location area network frequency band covering 2.4 GHz to 2.5 GHz. The third radiating conductor, the fourth radiating conductor and the parasitic element obtain a second wireless location area network frequency band covering 4.9 GHz to 5.87 GHz.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
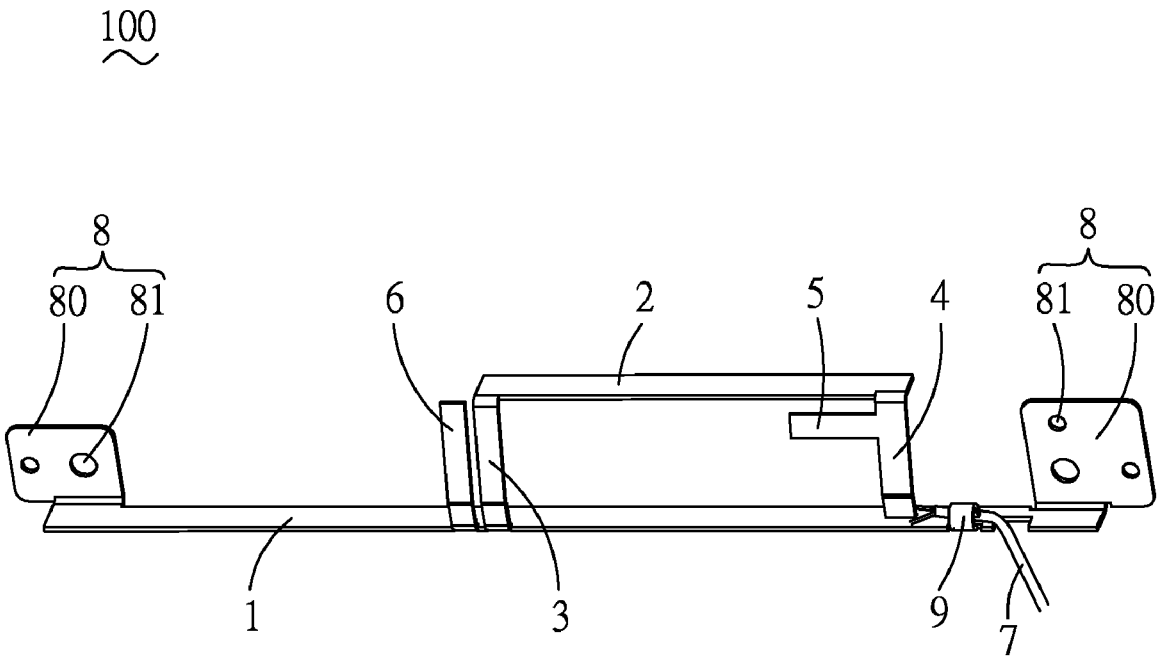
FIG. 1 shows a preferred embodiment of a dual band antenna according to the present invention.

Please refer to FIG. 1. A preferred embodiment of a dual band antenna 100 according to the present invention is shown. The dual band antenna 100 has a ground portion 1, a first radiating conductor 2, a second radiating conductor 3, a third radiating conductor 4, a fourth radiating conductor 5 and a parasitic element 6.

In this case, the ground portion 1, the first radiating conductor 2, the second radiating conductor 3, the third radiating conductor 4, the fourth radiating conductor 5 and the parasitic element 6 are all form as rectangle. The first radiating conductor 2 is defined opposite ends and spaced from one side of the ground portion 1. The second radiating conductor 3 connects one end of the first radiating conductor 2 and the ground portion 1. The third radiating conductor 4 connects the other end of the first radiating conductor 2.

In this case, the third radiating conductor 4 faces to the second radiating conductor 3. The fourth radiating conductor 5 extends from the third radiating conductor 4, which is close to the first radiating conductor 2. In this case, the fourth radiating conductor 5 extends towards the second radiating conductor 3. The parasitic element 6 connects the ground portion 1, which is arranged to close to the second radiating conductor 3.

For the downsizing purpose, the ground portion 1 and the first radiating conductor 2 are bent to perpendicular to the second radiating conductor 3 and the third radiating conductor 4. The second radiating conductor 3, the third radiating conductor 4, the fourth radiating conductor 5 and the parasitic element 6 are at same plane.

A feeding cable 7 is connected between the dual band antenna 100 and a wireless communication module of an electric device (not shown in figures) having a signal lead and a ground lead. One end of the signal lead of the feeding cable 7 connects the free end of the third radiating conductor 4 and one end of the ground lead connects the ground portion 1.

The dual band antenna 100 further has an antenna fixing portion 8 and a cable fixing portion 9. In this case, the antenna fixing portion 8 and the cable fixing portion form on the ground portion 1 of the dual band antenna 1. The cable fixing portion 9 forms as a curving shape for holding a portion of the feeding cable 7. The antenna fixing portion 8 has a plate 80 formed on both ends of the ground portion 1 and a through hole 81 opened through the plate 80.

Therefore, the dual band antenna 100 is configured in the electric device through the antenna fixing portion 8 and a mating fixing portion (not shown in figures) mating with the plate 80 and the through hole 81 of the antenna fixing portion 8. In this embodiment, the ground portion 1, the first radiating conductor 2, the second radiating conductor 3 and the third radiating conductor 4 form a loop antenna. The third radiating conductor 4 and the fourth radiating conductor 5 form as a monopole antenna. In this case, the dual band antenna 100 is made of thin foil.

When the dual band antenna 100 operates at wireless location area network bandwidth, the first radiating conductor 2, the second radiating 3 and the third radiating conductor 4 obtain an electrical resonance corresponding to a half wavelength corresponding to 2.4 GHz. The third radiating conductor 4 and the fourth radiating conductor 5 obtain an electrical resonance corresponding to a quarter wavelength corresponding to 5.2 GHz. The parasitic element 6 inducts electromagnetic from the second radiating conductor 3 to obtain an electrical resonance corresponding to a quarter wavelength corresponding to 5.2 GHz for improving bandwidth of 5.2 GHz band.

Figure 2:
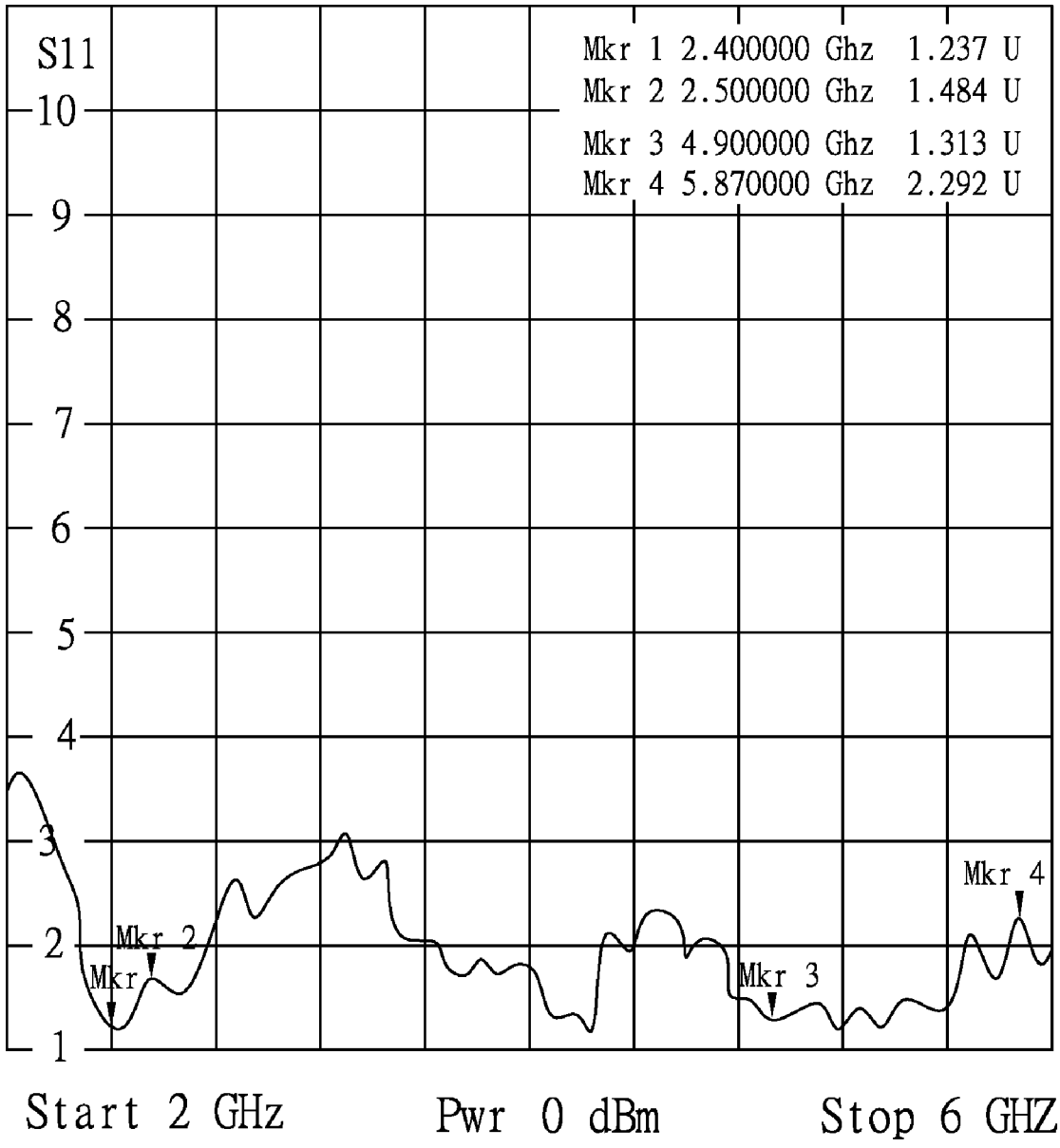
FIG. 2 is a test chart recording for the dual band antenna of FIG. 1, showing Voltage Standing Wave Ratio (VSWR) as a function of frequency.

Please refer to FIG. 2, which shows a test chart recording of Voltage Standing Wave Ratio (VSWR) of the dual band antenna 100 as a function of frequency. When the dual band antenna 100 operates at 2.4 GHz, the VSWR value is 1.237. When the dual band antenna 100 operates at 2.5 GHz, the VSWR value is 1.484. The VSWR value is 1.313, when the dual band antenna 100 operates at 4.9 GHz. The VSWR value is 2.292, when the dual band antenna 100 operates at 5.87 GHz. Therefore, the dual band antenna 100 obtains wireless location area network bandwidth covering 2.4 GHz to 2.5 GHz and 4.9 GHz to 5.87 GHz.

In this case, adjustment of the gap between the first radiating conductor 2 and the fourth radiating conductor 5, and the gap between the second radiating conductor 3 and the parasitic element 6 influences VSWR value of the dual band antenna 100. When the fourth radiating conductor 5 is adjusted to close to the ground portion 1, the VSWR value of the dual band antenna 100 between 2.4 GHz and 2.5 GHz is increased. Therefore, the gain of the dual band antenna 100 between 2.4 GHz and 2.5 GHz is decreased.

In the other hand, the VSWR value of the dual band antenna 100 between 4.9 GHz and 5.87 GHz is increased when the fourth radiating conductor 5 is adjusted to close to the first radiating conductor 2. Therefore, the gain of the dual band antenna 100 between 4.9 GHz and 5.87 GHz is decreased. When the parasitic element 6 is adjusted to remote from the second radiating conductor 3, the VSWR value of the dual band antenna 100 between 4.9 GHz and 5.87 GHz is increased and the gain of the dual band antenna 100 between 4.9 GHz and 5.87 GHz is decreased.

According to the arrangement of the ground portion 1, the first radiating conductor 2, the second radiating conductor 3, the third radiating conductor 4, the fourth radiating conductor 5 and the parasitic element 6, the dual band antenna 100 obtains wireless location area network bandwidth covering 2.4 GHz to 2.5 GHz and 4.9 GHz to 5.87 GHz.

Furthermore, the present invention is not limited to the embodiments described above; various additions, alterations and the like may be made within the scope of the present invention by a person skilled in the art. For example, respective embodiments may be appropriately combined.

What is claimed is:

1. A dual band antenna, comprising:

a ground portion;

a first radiating conductor defining two opposite ends and spaced from one side of said ground portion;

a second radiating conductor interconnected one end of said first radiating conductor and said ground portion;

a third radiating conductor connected to the other end of said first radiating conductor;

a fourth radiating conductor extended from said third radiating conductor;

a parasitic element arranged to close said second radiating conductor and connected to said ground portion;

a feeding point arranged at the free end of said third radiating conductor; and wherein said ground portion, said first radiating conductor, said second radiating conductor and said third radiating conductor form as a loop type antenna, said third radiating conductor and said fourth radiating conductor form as a monopole antenna.

2. The dual band antenna as claimed in claim 1, wherein said third radiating conductor is arranged to face said second radiating conductor.

3. The dual band antenna as claimed in claim 2, wherein said fourth radiating conductor extends towards said second radiating conductor.

4. The dual band antenna as claimed in claim 1, wherein said ground portion and said first radiating conductor are perpendicular to said second radiating conductor and said third radiating conductor.

5. The dual band antenna as claimed in claim 1, further comprising a cable fixing portion and an antenna fixing portion formed on said ground portion of said dual band antenna, said cable fixing portion holds a feeding cable connected to the feeding point.

6. The dual band antenna as claimed in claim 5, wherein said cable fixing portion forms as a curving shape, said antenna fixing portion has a plate formed on both ends of the ground portion and a through hole opened through the plate.

7. The dual band antenna as claimed in claim 3, wherein the adjustment of the gap between said first radiating conductor and said fourth radiating conductor, and the gap between said second radiating conductor and said parasitic element influences the gain of said dual band antenna.

8. The dual band antenna as claimed in claim 1, wherein said dual band antenna is made of thin foil.

* * * * *